US007147525B2

(12) United States Patent
Sasayama et al.

(10) Patent No.: US 7,147,525 B2
(45) Date of Patent: Dec. 12, 2006

(54) HYDRAULIC STEERING APPARATUS FOR AN OUTBOARD ENGINE

(75) Inventors: Katsuhiko Sasayama, Kobe (JP); Katsuhiko Arakawa, Kobe (JP)

(73) Assignees: Marol Co., Ltd., Kobe (JP); Y's Gear Co., Ltd., Shizuoka (JP)

( * ) Notice: Subject to any disclaimer, the term of this patent is extended or adjusted under 35 U.S.C. 154(b) by 0 days.

(21) Appl. No.: 11/032,146

(22) Filed: Jan. 11, 2005

(65) Prior Publication Data

US 2005/0164572 A1 Jul. 28, 2005

(30) Foreign Application Priority Data

Jan. 26, 2004 (JP) ..... 2004-017068

(51) Int. Cl.
*B63H 5/125* (2006.01)
*B63H 25/22* (2006.01)

(52) U.S. Cl. ..... 440/61 R; 114/150

(58) Field of Classification Search ..... 440/61 R, 440/61 H, 61 J, 61 L, 61 D, 61 A, 61 S, 440/53; 114/150
See application file for complete search history.

(56) References Cited

U.S. PATENT DOCUMENTS 4,373,920 A * 2/1983 Hall et al. ..... 440/59
5,542,864 A * 8/1996 Peebles ..... 440/61 R
5,997,370 A * 12/1999 Fetchko et al. ..... 440/61 R
7,037,152 B1 * 5/2006 Sasayama et al. ..... 440/61 S

FOREIGN PATENT DOCUMENTS

JP 2002-331997 11/2002

* cited by examiner

*Primary Examiner*—Jesús D. Sotelo
(74) *Attorney, Agent, or Firm*—Wenderoth, Lind & Ponack, L.L.P.

(57) ABSTRACT

A hydraulic steering apparatus 1 has a substantially bow-shaped frame 2, which includes a pair of end portions 2*a* bent forward. A piston rod 3 is supported by and between the end portions 2*a*. A hydraulic cylinder 5 is supported by the piston rod 3 slidably along it. The frame 2 also includes a middle portion 2A, which has bolt holes 2B cut through it. Bolts 11 extend through the bolt holes 2B and engage with the front end of the swivel bracket 41 of an outboard engine 40 to fix the frame 2 to the bracket. The cylinder 5 is linked to the front end of the steering lever 46 of the engine 40 by a steering link 7.

6 Claims, 7 Drawing Sheets

Fig, 1

HYDRAULIC STEERING APPARATUS FOR AN OUTBOARD ENGINE

FIELD OF THE INVENTION

The present invention relates to a hydraulic steering apparatus for the outboard engine mainly of a small vessel such as a fishing boat, a motorboat or a yacht. The engine is supported by a swivel bracket and can turn right and left on a steering axis. The steering apparatus is fixed to the swivel bracket. The swivel bracket is supported tiltably on a horizontal tilt axis by one or more clamp brackets, which are fixed to the transom of the stern of the vessel. In particular, the invention relates to a structure for mounting the steering apparatus.

BACKGROUND OF THE INVENTION

In general, an outboard engine of this type is supported by a swivel bracket and can be turned right and left on a roughly vertical steering axis to steer the vessel. The swivel bracket is positioned between a pair of clamp brackets. It is possible to steer the vessel by turning the steering wheel of a steering apparatus, which includes either a mechanical device or a hydraulic device of the cantilever type or both-end support type.

The mechanical device has a push-pull cable, which includes an outer cable and an inner cable. The outer cable is connected to one end of a guide tube, which extends along a horizontal tilting axis through the clamp and swivel brackets. The inner cable extends through the guide tube, protrudes from its other end is connected through a link to a steering lever, which is fixed to the engine housing. Because the pushing force and pulling force transmitted by the inner cable are limited, the mechanical device is used for an outboard engine having relatively low horsepower.

The hydraulic device of the cantilever type has a hydraulic cylinder and a horizontal piston rod. One end of the hydraulic cylinder is fitted to one end of a guide tube, which extends along a horizontal tilting axis through the clamp and swivel brackets. One end of the piston rod is connected through a link to a steering lever, which is fixed to the engine housing. Because the moment exerted on the link is limited, this hydraulic device as well is used for an outboard engine having relatively low horsepower.

As stated above, a push-pull cable is connected to only one end of the guide tube, or one end of a hydraulic cylinder is fixed to only one end of the tube. This causes no inconvenience because the thread of one end of the guide tube is standardized in outer diameter.

The hydraulic device of the both-end support type is used for an outboard engine having high horsepower. This hydraulic device as well has a hydraulic cylinder and a horizontal piston rod. Both ends of the piston rod are supported by a pair of arms, which is fitted to a guide tube. The guide tube extends along a horizontal tilting axis through the clamp and swivel brackets. The hydraulic cylinder slides along the piston rod to steer the vessel.

Against such a background, the outboard engines made by different makers are so standardized that one end (generally the starboard end) of each guide tube has an external thread that is ⅞ inch in outer diameter. Each maker sets its own outer diameter of the external thread of other end, which may be ⅞ inch or 20 mm.

One end of the guide tube is fitted with a cylindrical nut fit for the ⅞ inch thread. The cylindrical nut makes it possible to fit the push-pull cable or the hydraulic cylinder of the cantilever device smoothly to this end of the guide tube.

One arm of the hydraulic device of the both-end support type is fitted to one end of the guide tube by fittings including a cylindrical nut fit for the ⅞ inch thread. However, before the other arm is fitted to the other end of the guide tube, it is necessary to buy fittings fit for this tube. It is inconvenient and may take a long time to buy the fittings. Even if fittings are bought, they may not be fit for the guide tube.

FIG. 7 of the accompanying drawings shows a steering apparatus including a hydraulic device of the both-end support type. This hydraulic device has a horizontal hydraulic cylinder 26, through which a piston rod 25 slides. Each end of the piston rod 25 is supported by the front end of an arm 23, the rear end of which is supported turnably by one end of a guide tube 48. The guide tube 48 extends along a horizontal tilting axis through a pair of clamp brackets 42 and a swivel bracket 41. The clamp brackets 42 are fixed to the hull (stern) of a boat. The swivel bracket 41 is positioned between the clamp brackets 42 and has a central recess 43 formed in its front end. The hydraulic cylinder 26 is connected through a steering link 47 to the front end of a steering lever 46, which is fixed to the housing of an outboard engine 40.

The guide tube 48 has external threads 48*a* and 48*b* cut in both its ends, which engage with cylindrical nuts 31. Each cylindrical nut 31 includes a sleeve 32. Each arm 23 has a bearing hole 23*a* cut through its rear end, through which the associated sleeve 32 extends so that the arms 23 can pivot on the tilting axis. A nut 34 engages with the outer end of each sleeve 32.

A similar steering apparatus is disclosed in Japanese unexamined patent publication No. 2002-331997 (paragraphs 0017–0019 and FIGS. 1–3).

As stated above, an arm is fitted to each end of the guide tube. In this case, each of the makers of outboard engines sets its own outer diameter of the thread of one end of the guide tube. This makes it necessary to order exclusive fittings after knowing the maker of the outboard engine for which the steering apparatus is to be used. It may take a long time to buy the fittings, and wrong fittings may be bought.

The arms extend from the guide tube on the tilting axis backward and toward the hull. The rear ends of the arms support the piston rod, which supports the hydraulic cylinder. As a result, great moments are exerted on the arms. For this reason, the arms and other parts need to have high strength. This makes the steering apparatus complex in structure and heavy.

SUMMARY OF THE INVENTION

The object of the present invention is to provide a hydraulic steering apparatus that is simple in structure, compact, small and light, that can be produced at a low cost, and that includes a piston rod supported by a frame which can be fixed directly to the swivel bracket of an outboard engine of any type, and on which a low load is exerted.

According to the present invention, a hydraulic steering apparatus is provided for a vessel having an outboard engine supported by the stern of the vessel hull. A pair of clamp brackets is fixed to the stern. A swivel bracket is positioned between the clamp brackets and supported by them tiltably on a tilting axis, which extends horizontally across the vessel. The outboard engine is supported by the swivel bracket turnably on a steering axis, which is perpendicular to the tilting axis. The steering apparatus has a substantially bow-shaped horizontal frame, which includes a middle portion and a pair of end portions bent forward. The middle portion has bolt holes cut through it. Bolts extend through the bolt holes and engage with the front end of the swivel bracket to fix the frame to this end. The end portions support a piston rod, which extends in parallel with the tilting axis. The piston rod supports a hydraulic cylinder, which can slide along it. A steering lever is fixed to the outboard engine and has a front end, which can move around the steering axis to turn the engine on this axis. The front end of the steering lever is linked to the hydraulic cylinder by a steering link.

The middle portion of the frame can be fixed directly to the swivel bracket of the outboard engine by the bolts. This makes it easy to fit the steering apparatus to the swivel bracket and shortens the end portions of the frame so that the frame is loaded lower.

The bolt holes of the frame may be adapted for the swivel brackets of outboard engines made by different makers. This makes it possible to fit the frame to any one of the different engines, so that the frame can be used widely.

While the hydraulic cylinder slides along the piston rod, the angle between the steering lever and link changes.

The swivel bracket may include a pair of side portions formed at its front end, which define a recess between them. A guide plate may be fitted in the recess. The guide plate includes a pair of end portions bent at right angles. These end portions engage with the inner sides of the side portions of the swivel bracket. The guide plate has a tapped hole cut in its middle. The frame further has a middle bolt hole cut through its middle. A bolt extends through the middle bolt hole of the frame, engages with the tapped hole of the guide plate and is tightened.

When the hydraulic cylinder slides, shearing forces are exerted on the bolts fixing the frame to the swivel bracket. The shearing forces are reduced greatly by the guide plate, so that the bolts are not liable to bend or break even if the apparatus is used for a long time.

The middle portion of the frame may have a pair of projections formed on its rear side and spaced from each other. The middle portion may have a pair of inner bolt holes cut through it. Each of the projections has an outer sloping side and an inner sloping side. The steering apparatus may be fitted with a pair of nuts, each of which has a flat side in contact with the inner side of one of the side portions of the swivel bracket and an inclined side in contact with the outer sloping side of one of the projections. Each of the nuts further has a tapped hole cut in it. Bolts extend through the inner bolt holes of the frame, engage with the tapped holes of the nuts and are tightened.

As is the case with the guide plate, the projections of the frame greatly reduce the shearing forces exerted on the bolts fixing the frame to the swivel bracket.

Each of the end portions of the frame may have an end hole cut through it, which has a hemispherical surface. The piston rod extends through the end holes of the frame. The piston rod may have a pair of screw stocks each extending from its one end. Each of the screw stocks protrudes outward from the adjacent end hole. A nut engages with one of the screw stocks and is tightened. A washer is interposed between the nut and the adjacent end portion of the frame. The washer has a hemispherical surface in contact with the hemispherical surface of the adjacent end hole of the frame.

When the frame is fitted to the swivel bracket of the outboard engine, the frame may be distorted. Even if the frame is distorted, the hemispherical washer (spherical nut) absorbs the distortion of the piston rod, which is supported by the end portions of the frame. Accordingly, the piston rod is not liable to be distorted. This enables the hydraulic cylinder to slide smoothly along the piston rod.

The steering apparatus achieves the following outstanding effects.

The steering apparatus is easy to fit. The frame is not liable to be high loaded. The bolt holes of the frame may be adapted for the swivel brackets of outboard engines made by different makers. This makes it possible to fit the frame to any one of the different engines. The steering apparatus is simple in structure, durable and small in size, and can be produced at a low cost.

The frame can be fixed to the swivel bracket of any one of the outboard engines of different makers easily and securely by bolts.

The frame can be fixed in a very short time as compared with the conventional case where the user orders fittings after knowing the maker or type of the outboard engine for which the steering apparatus is to be used.

The maker of the steering apparatus does not need to provide different types of fittings. This prevents purchase of wrong fittings, makes it possible to efficiently fix the frame etc., and reduces costs.

BRIEF DESCRIPTION OF THE DRAWINGS

Preferred embodiments of the present invention are shown in the accompanying drawings, in which.

DETAILED DESCRIPTION OF PREFERRED EMBODIMENTS

Figure 3:
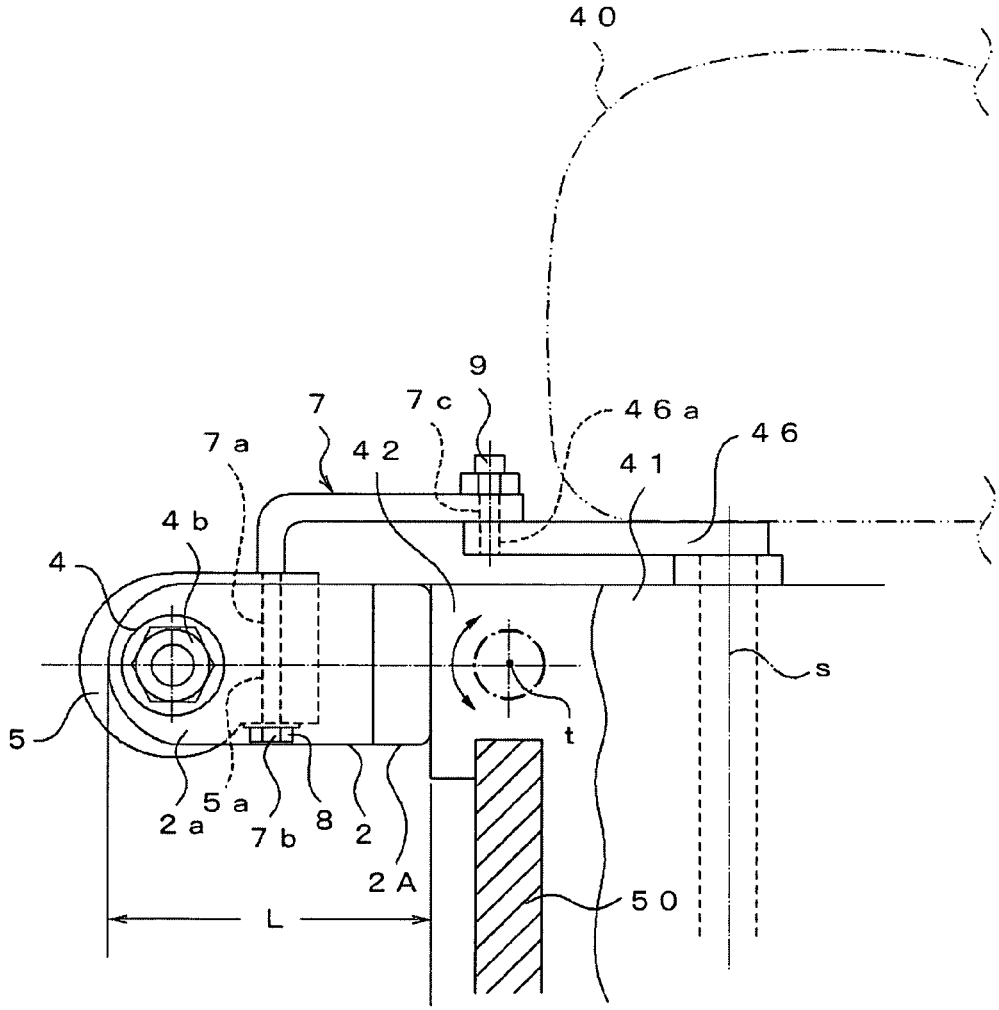
FIG. 3 is a side view of the hydraulic steering apparatus as seen in direction A in FIG. 1.
Figure 4:
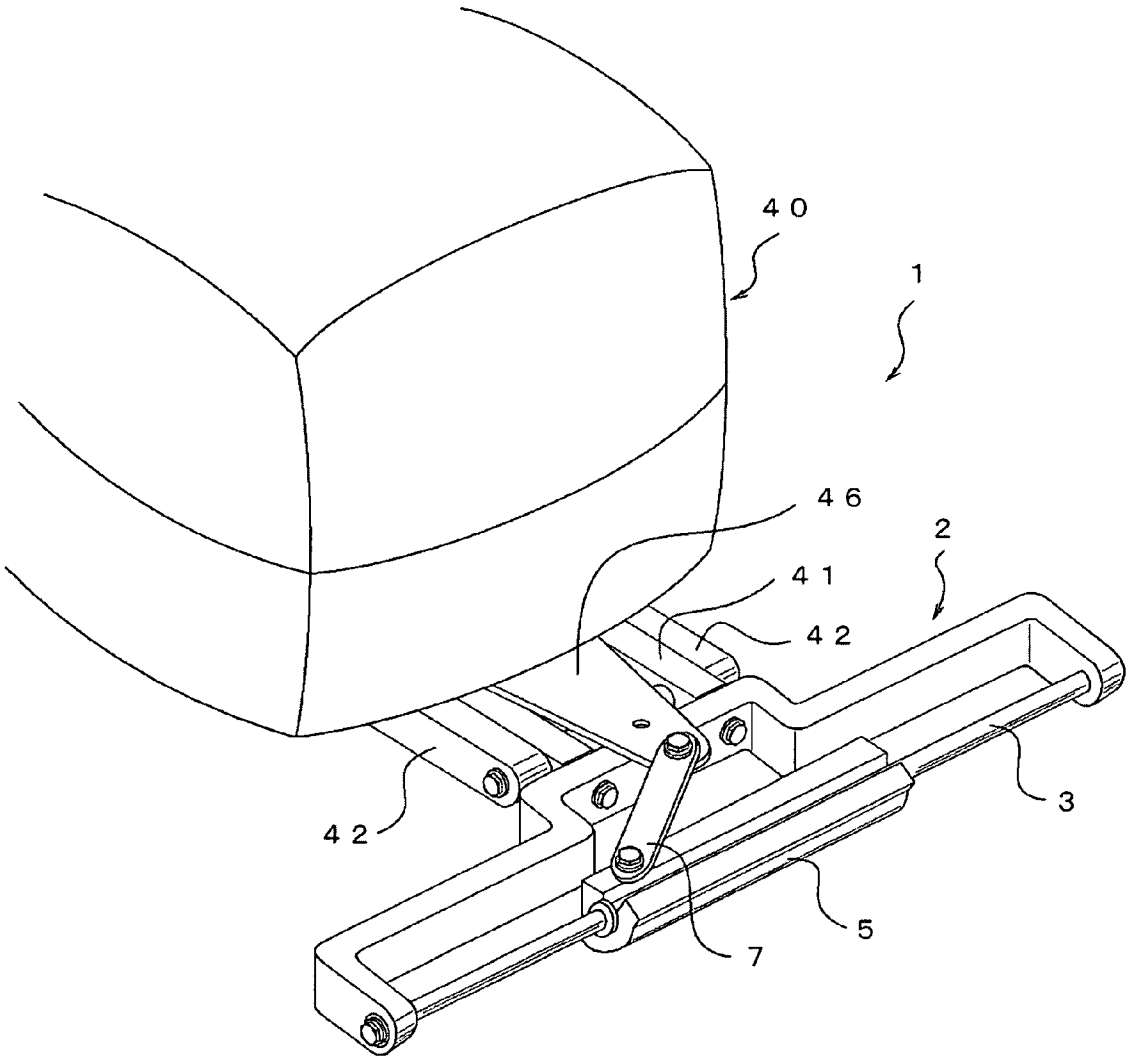
FIG. 4 is a perspective view of the hydraulic steering apparatus as fixed to the swivel bracket of an outboard engine.

With reference to FIGS. 3 and 4, a pair of clamp brackets 42 is fixed to the transom 50 of the stern of a boat. A swivel bracket 41 is positioned between the clamp brackets 42, which so support its front end that the swivel bracket 41 can tilt on a horizontal tilting axis t parallel with the transom 50. The swivel bracket 41 so supports an outboard engine 40 that the engine can turn right and left on a steering axis s.

Figure 1:
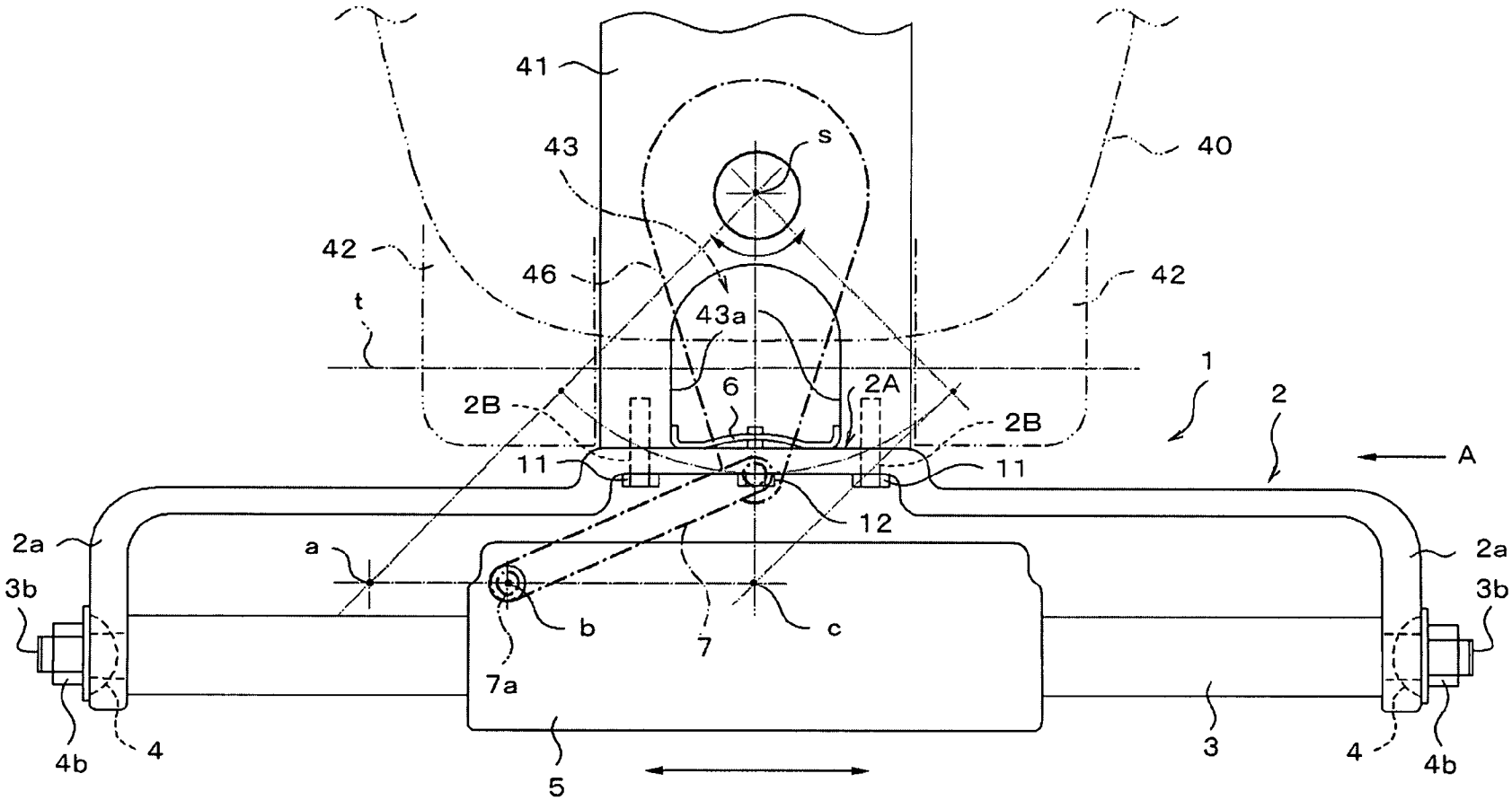
FIG. 1 is top plan of a hydraulic steering apparatus embodying the present invention.
Figure 2:
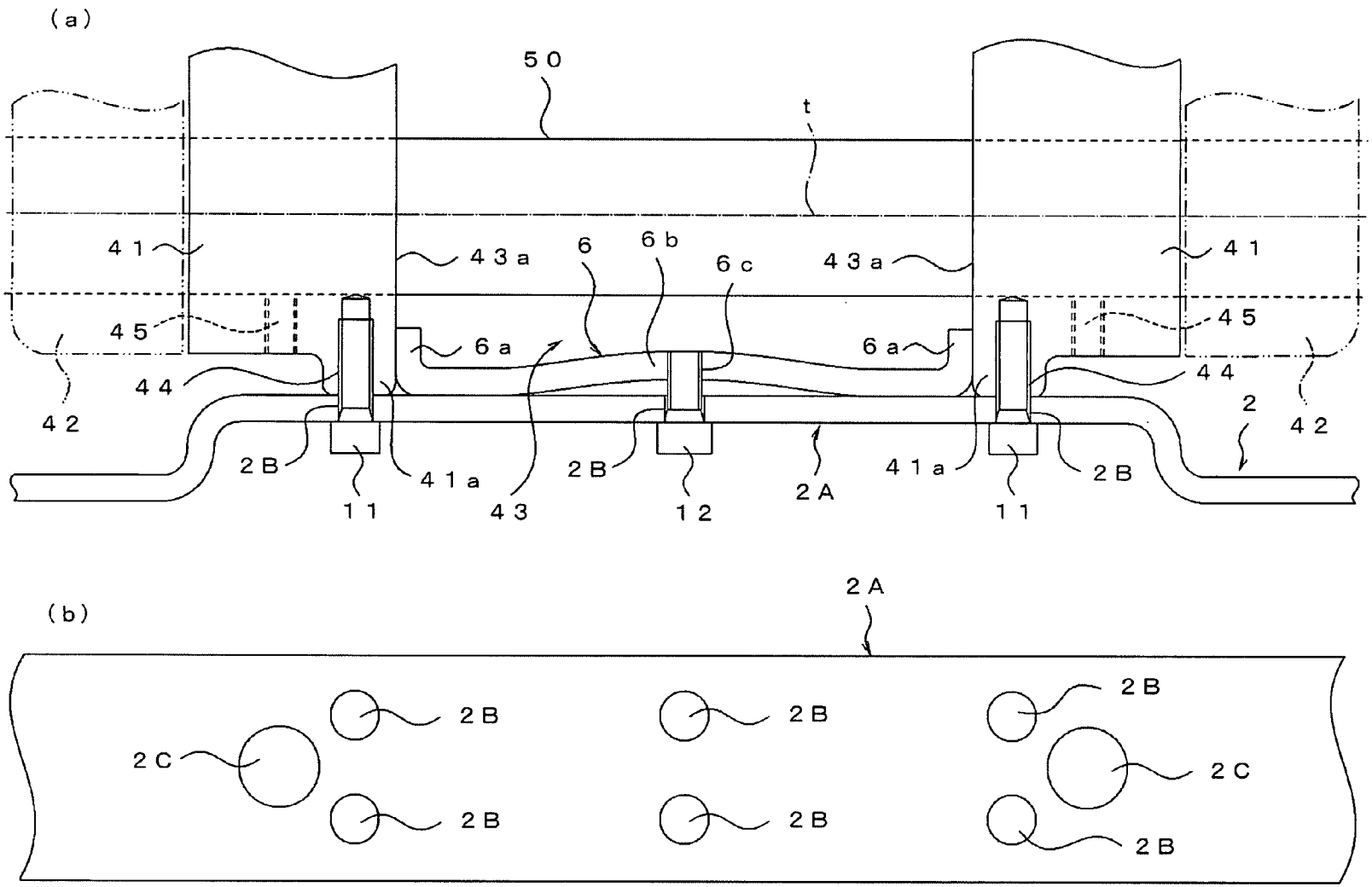
FIG. 2*a* is an enlarged top plan of part of FIG. 1.
FIG. 2*b* is an enlarged front view of a middle portion of the arm of the hydraulic steering apparatus.
Figure 7:
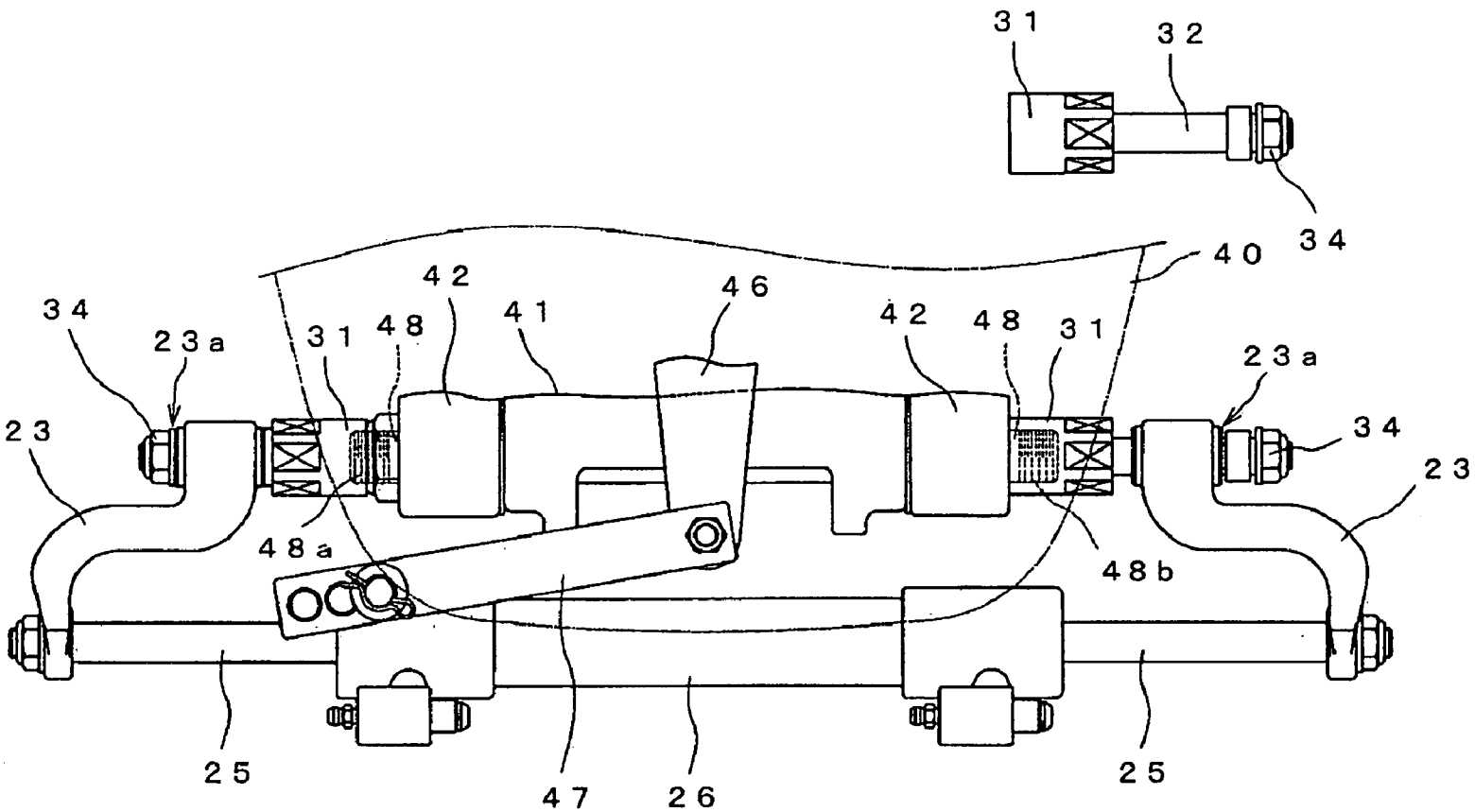
Fig. 7 (PRIOR ART)
FIG. 7 is a top plan of a conventional hydraulic steering apparatus.

With reference to FIGS. 1 and 2*a*, the swivel bracket 41 has a central U-shaped recess 43 formed through a front portion of it. Both sides of the recess 43 are defined by a pair of side portions 41*a* of the swivel bracket 41. Each side portion 41*a* has two tapped holes 44 cut in its front end, one of which is positioned over the other. Each side portion 41*a* also has a grease hole 45 cut in its front end and on the outer side of the tapped holes 44. The recess 43 might be shallower as shown in FIG. 7.

A hydraulic steering apparatus 1 embodying the present invention has a roughly bow-shaped frame 2, which may be either a die-cast molding or a press molding that is a bent metal plate having a constant width. The frame 2 has a pair of end portions 2*a* bent forward at right angles. The front ends of the end portions 2*a* support a piston rod 3, which is parallel with the tilting axis t.

Figure 5:
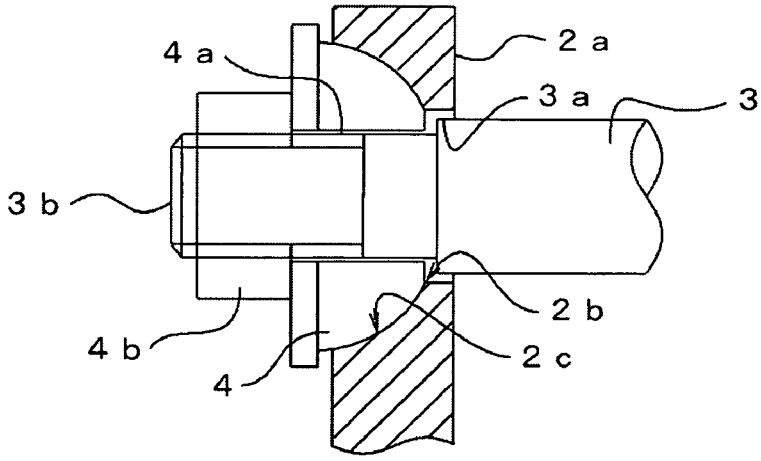
FIG. 5 is an enlarged sectional view of end portions of the arm and the piston rod of the hydraulic steering apparatus, showing how they are connected.

As shown in FIG. 5, the front end of each end portion 2*a* of the frame 2 has a cylindrical hole 2*b* cut on its inner side and a hemispherical hole 2*c* cut on its outer side. The holes 2*b* and 2*c* communicate with each other. Each end 3*a* of the piston rod 3 is positioned in one of the cylindrical holes 2*b*, with clearance allowed between the rod 3 and frame 2. The piston rod 3 has a pair of screw stocks 3*b* extending from its ends 3*a* and having a slightly smaller diameter. A washer 4 has a hemispherical surface and a central bore 4*a*. The hemispherical surface is in engagement with the hemispherical hole 2*c* of each end portion 2*a* of the frame 2. Each screw stock 3*b* extends through the associated washer bore 4*a*. A nut 4*b* is in engagement with each screw stock 3*b* and tightened to fix the piston rod 3 to the frame 2. Under this condition, the piston rod 3 is supported without being deformed by torsion or other slight deformation of the frame 2. Torsion or deformation of the piston rod 3 is prevented even if the frame 2 is deformed by a great external force exerted on the outboard engine 40 or swivel bracket 41 while the boat is running.

The piston rod 3 extends through a hydraulic cylinder 5, which can slide along it. The hydraulic cylinder 5 has inlet/outlet ports (not shown) formed in both its ends. A helm pump (not shown) pumps hydraulic oil from a hydraulic tank through a hydraulic hose to one of the inlet/outlet ports, and back from the other port through another hydraulic hose into the tank. This moves the hydraulic cylinder 5 in one direction along the piston rod 3. In general, the helm pump is operated when the steering wheel (not shown) of the boat is turned.

The frame 2 includes a middle portion 2A recessed or offset backward. As best shown in FIG. 2*b*, the middle portion 2A has three pairs of bolt holes 2B cut through it. One pair of bolt holes 2B is positioned in the middle of the middle portion 2A, and the other pairs are on both its sides. One of the bolt holes 2B of each pair is positioned over the other hole. Bolts 11 extend through the outer pairs of bolt holes 2B and engage with the tapped holes 44 of the swivel bracket 41 to fix the frame 2 to the front end of this bracket.

The middle portion 2A of the frame 2 also has two slightly larger holes 2C cut through it on the outer sides of the outer pairs of bolt holes 2B. Grease can be applied through these holes 2C.

The middle pair of bolt holes 2B of the frame 2 is used to fix a guide plate 6 as an anti-shearing member to the frame 2. The guide plate 6 has a pair of end portions 6*a* bent backward at right angles and a middle portion 6*b* recessed gently backward. The middle portion 6*b* has two tapped holes 6*c* cut through its middle. One of the tapped holes 6*c* is positioned over the other. The guide plate 6 is positioned in the recess 43 of the swivel bracket 41, with its end portions 6*a* in contact with the inner sides 43*a* of the side portions 41*a* of this bracket. Bolts 12 extend through the middle pair of bolt holes 2B and engage with the tapped holes 6*c*. The bolts 12 are tightened to force the recessed portion 6*b* of the guide plate 6 toward the frame 2, thereby bringing the end portions 6*a* of this plate into compressive contact with the side portions 41*a* of the swivel bracket 41.

Thus, the steering apparatus 1 is fixed to the front end of the swivel bracket 41 of the outboard engine 40.

The outboard engine 40 is fitted with a steering lever 46, the rear end of which is fixed to its bottom. The steering lever 46 has a tapped hole 46*a* cut through its front end. A steering link 7 has a bolt hole 7*c* cut through its one end. A bolt 9 extends loosely through the bolt hole 7*c* and engages with the tapped hole 46*a* so that the steering link 7 can pivot on an axis parallel with the steering axis s. The steering link 7 also has a pin 7*a* extending downward from its other end and in parallel with the steering axis s. The hydraulic cylinder 5 has a pin hole 5*a* cut through it near its one end. The link pin 7*a* extends loosely through the pin hole 5*a* and has a thread 7*b* cut at its bottom. A nut 8 engages with the pin thread 7*b*.

FIG. 1 shows the hydraulic cylinder 5 as being in its neutral position, where the link pin 7*a* is at point b.

With the hydraulic cylinder 5 in its neutral position, when the steering wheel is turned counterclockwise, hydraulic oil is supplied to the left (right in FIG. 1) inlet/outlet port of the cylinder. This slides the hydraulic cylinder 5 to the right (left in FIG. 1) along the piston rod 3, moving the link pin 7*a* from point b toward point a. Consequently, the steering lever 46 turns clockwise with the outboard engine 40, so that the angle between the lever and the steering link 7 approaches 180 degrees. As a result, the boat steers to the left.

With the hydraulic cylinder 5 in its neutral position, when the steering wheel is turned clockwise, hydraulic oil is supplied to the right (left in FIG. 1) inlet/outlet port of the cylinder. This slides the hydraulic cylinder 5 to the left (right in FIG. 1) along the piston rod 3, moving the link pin 7*a* from point b toward point c. Consequently, the steering lever 46 turns counterclockwise with the outboard engine 40, so that the angle between the lever and the steering link 7 approaches 90 degrees. As a result, the boat steers to the right.

When the hydraulic cylinder 5 slides along the piston rod 3, shearing forces are exerted mainly on portions of the frame 2 that surround the outer bolts 11. Whichever direction the hydraulic cylinder 5 slides in, the shearing forces are resisted by the guide plate 6, which is fixed to the middle portion 2A of the frame 2 and in compressive contact with the inner sides 43*a* of the side portions 41*a* of the swivel bracket 41. Consequently, little shearing force is exerted on the bolts 11 and 12. The moment exerted on the six bolts 11 and 12 is dispersed by them. The moment exerted on the frame 2 is small because the frame is fixed directly to the front end of the swivel bracket 41, and because, as shown in FIG. 3, the distance L between this bracket end and the front ends of the frame end portions 2*a*, which support the piston rod 3 and hydraulic cylinder 5, is short.

Figure 6:
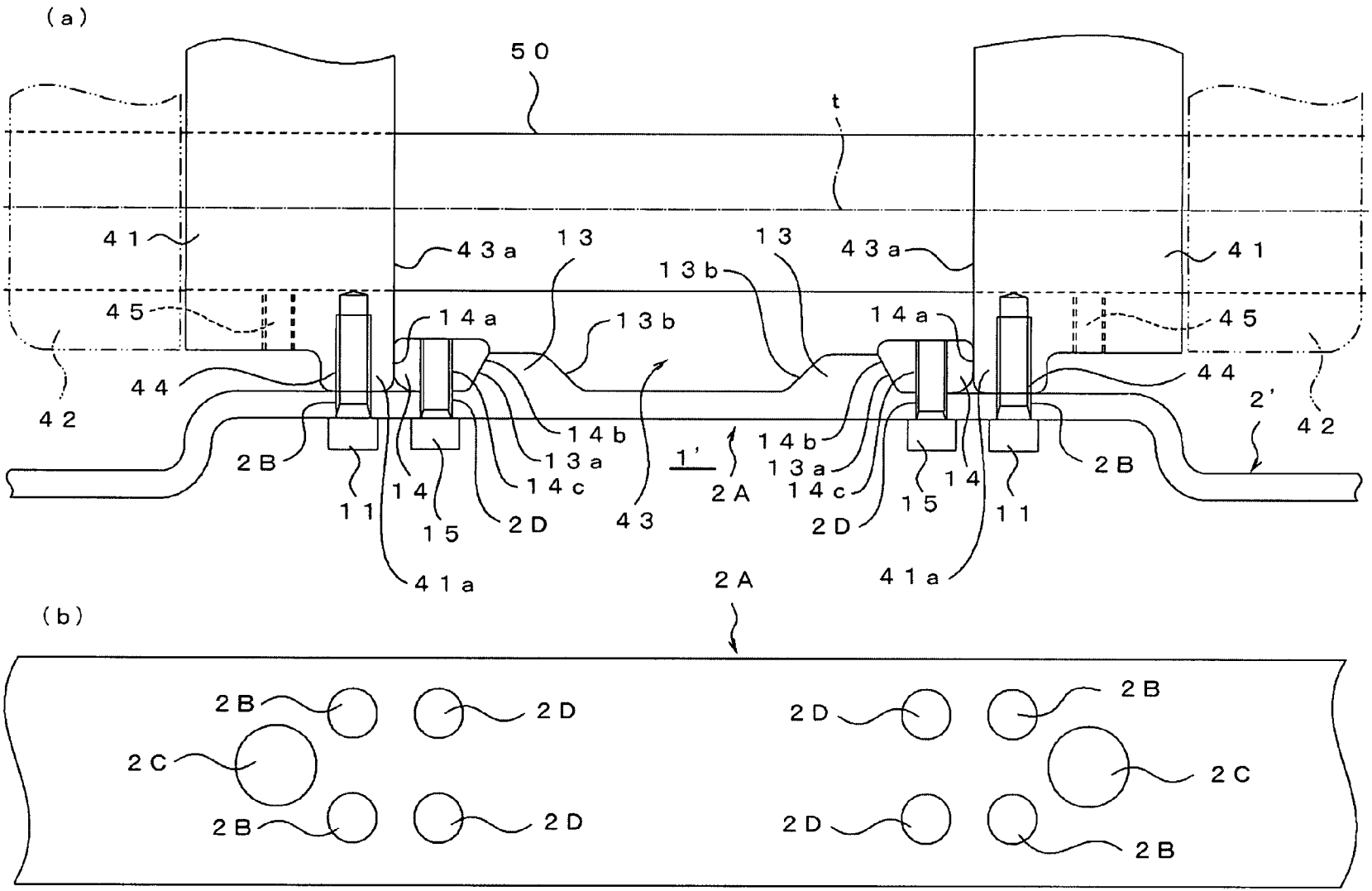
FIGS. 6*a* and 6*b* are views similar to FIGS. 2*a* and 2*b*, respectively, but showing another hydraulic steering apparatus embodying the present invention.

FIGS. 6*a* and 6*b* show another hydraulic steering apparatus 1' embodying the present invention. The steering apparatus 1' has a frame 2', which is bolted to the front end of a swivel bracket 41 identical with that shown in FIGS. 1, 2*a*, 3 and 4. The frame 2' includes a middle portion 2A recessed or offset backward.

The middle portion 2A of the frame 2' has a pair of projections 13 formed on its rear side. Each projection 13 is spaced inward from the inner side 43*a* of the adjacent side portion 41*a* of the swivel bracket 41. Each projection 13 has an outer side 13*a* and an inner side 13*b*, which slope at angles of about 30 and 45 degrees, respectively, to the inner sides 43*a* of the bracket portions 41*a*. The middle portion 2A also has two pairs of bolt holes 2B cut through it. One of the bolt holes 2B of each pair is positioned over the other hole. The middle portion 2A further has two pairs of bolt holes 2D cut through it. Each pair of bolt holes 2D is positioned on the inner side of one pair of bolt holes 2B. One of the bolt holes 2D of each pair is positioned over the other hole.

Bolts 11 extend through the bolt holes 2B and engage with the tapped holes 44 of the swivel bracket 41.

The steering apparatus 1' has a pair of nuts 14 in place of the guide plate 6. Each nut 14 has a flat side 14*a* for engaging with the inner side 43*a* of one of the bracket portions 41*a* and an inclined side 14*b* for engaging with the outer side 13*a* of one of the nuts 13. Each nut 14 also has two tapped holes 14*c* cut through it. Bolts 15 extend through the bolt holes 2D of the frame 2' and engage with the tapped holes 14*c* of the nuts 14. The bolts 15 are tightened to fix the frame 2' securely to the front end of the swivel bracket 41.

Thus, the steering apparatus 1' is fixed to the swivel bracket 41 without extending greatly from the front end of this bracket. This makes the steering apparatus 1' compact.

With reference to FIGS. 1 and 5, the piston rod 3 could be fixed to the frame 2 only by the nuts 4*b*, without the washers 4 interposed. Alternatively, a spherical nut including a hemispherical washer might fix the piston rod 3 to the frame 2.

What is claimed is:

1. A hydraulic steering apparatus for a vessel having an outboard engine supported by the stern of the vessel hull, the vessel further having a pair of clamp brackets fixed to the stern, the vessel further having a swivel bracket positioned between the clamp brackets, the swivel bracket supported by the clamp brackets tiltably on a tilting axis extending horizontally across the vessel, the outboard engine supported by the swivel bracket turnably on a steering axis perpendicular to the tilting axis, the steering apparatus comprising:

a substantially bow-shaped horizontal frame including a middle portion and a pair of end portions bent forward, the middle portion having bolt holes cut therethrough;

bolts extending through the bolt holes and engaging with the front end of the swivel bracket to fix the frame to the front end;

a piston rod extending in parallel with the tilting axis and supported by the end portions of the frame;

a hydraulic cylinder supported by the piston rod slidably therealong;

a steering lever fixed to the outboard engine;

the steering lever having a front end movable around the steering axis to turn the outboard engine on the steering axis; and a steering link linking the front end of the steering lever to the hydraulic cylinder.

2. The hydraulic steering apparatus of claim 1 wherein the swivel bracket includes a pair of side portions formed at the front end thereof, the side portions defining a recess therebetween, the steering apparatus further comprising:

a guide plate fitted in the recess;

the guide plate including a pair of end portions bent at right angles, the end portions of the plate engaging with the inner sides of the side portions of the swivel bracket;

the guide plate having a tapped hole cut in the middle thereof;

the frame further having a middle bolt hole cut through the middle thereof; and a bolt extending through the middle bolt hole of the frame, engaging with the tapped hole of the guide plate and tightened.

3. The hydraulic steering apparatus of claim 1 wherein the swivel bracket includes a pair of side portions formed at the front end thereof, the side portions defining a recess therebetween, and wherein the middle portion of the frame has a pair of projections formed on the rear side thereof and spaced from each other, the middle portion further having a pair of inner bolt holes cut therethrough, the projections each having an outer sloping side and an inner sloping side, the steering apparatus further comprising:

a pair of nuts each having a flat side in contact with the inner side of one of the side portions of the swivel bracket and an inclined side in contact with the outer sloping side of one of the projections;

the nuts each further having a tapped hole cut therein; and a pair of inner bolts extending through the inner bolt holes of the frame, engaging with the tapped holes of the nuts and tightened.

4. The hydraulic steering apparatus of any one of claim 1 wherein each of the end portions of the frame has an end hole cut therethrough, the end hole having a hemispherical surface, the piston rod extending through the end holes of the frame, the piston rod having a pair of screw stocks each extending from one end thereof, the screw stocks each protruding outward from the adjacent end hole, the steering apparatus further comprising:

a pair of nuts each engaging with one of the screw stocks and tightened; and a pair of washers each interposed between one of the nuts and the adjacent end portion of the frame;

the washers each having a hemispherical surface in contact with the hemispherical surface of the adjacent end hole of the frame.

5. The hydraulic steering apparatus of claim 2 wherein each of the end portions of the frame has an end hold cut therethrough,the end hole having a hemispherical surface, the piston rod extending through the end holes of the frame, the piston rod having a pair of screw stocks each extending from one end thereof, the screw stocks each protuding outward from the adjacent end hole, the steering apparatus further comprising:

a pair of nuts each engaging with one of the screw stocks and tightened; and a pair of washers each interposed between one of the nuts and the adjacent end portion of the frame;

the washers each having a hemispherical surface in contact with the hemispherical surface of the adjacent end hold of the frame.

6. The hydraulic steering apparatus of claim 3 wherein each of the end portions of the frame has an end hold cut therethrough, the end hold having a hemispherical surface, the piston rod extending from one end thereof, the screw stocks each protruding outward from the adjacent end hole, the steering apparatus further comprising:

a pair of nuts each engaging with one of the screw stocks and tightened; and a pair of washers each interposed between one of the nuts and the adjacent end portion of the frame;

the washer each having a hemispherical surface in contact with the hemispherical surface of the adjacent end hole of the frame.

* * * * *